United States Patent [19]

Holzer

[11] Patent Number: 4,564,411

[45] Date of Patent: Jan. 14, 1986

[54] APPARATUS FOR PRODUCING LABELS

[75] Inventor: Joseph C. Holzer, Liverpool, N.Y.

[73] Assignee: Gaylord Bros., Inc., Liverpool, N.Y.

[21] Appl. No.: 560,843

[22] Filed: Dec. 13, 1983

[51] Int. Cl.[4] ..... B41J 15/16; B41J 15/22; B41J 15/24

[52] U.S. Cl. ..... 156/387; 156/277; 156/494; 156/555; 242/75.4; 242/156; 400/615.1; 400/617; 400/618; 400/609

[58] Field of Search ..... 156/277, 384, 387, 494, 156/555, 324, 543, 550, 551, 549, 271; 400/615, 615.1, 606, 617, 618, 609; 242/75.4, 99, 156

[56] References Cited

U.S. PATENT DOCUMENTS

| | | | |
|---|---|---|---|
| 980,682 | 1/1911 | Saracco | 242/156 |
| 1,260,819 | 3/1918 | Schwarzmann et al. | 242/57 |
| 1,567,483 | 12/1925 | Bear | 242/99 |
| 1,616,833 | 2/1927 | Stremel | 124/18 |
| 1,690,514 | 11/1928 | Walter et al. | 156/271 |
| 1,818,459 | 8/1931 | Bryan | 101/219 |
| 1,821,461 | 9/1931 | Chudley | 242/156 |
| 1,961,028 | 5/1934 | Youell | 400/618 |
| 1,974,594 | 9/1934 | Angier | 156/324 |
| 2,205,980 | 6/1940 | Keller et al. | 101/219 |
| 2,249,297 | 7/1941 | Muffett | 242/84.5 R |
| 2,256,818 | 9/1941 | Sperry | 188/83 |
| 2,384,561 | 9/1945 | Muffett | 242/84.52 R |
| 2,568,182 | 9/1951 | Anania | 242/156 |
| 2,590,239 | 3/1952 | Elsman | 156/277 |
| 2,598,892 | 6/1952 | Critchlow, Jr. et al. | 156/277 |
| 3,295,654 | 1/1967 | Clinton et al. | 400/615.1 |
| 3,707,415 | 12/1972 | Golladay et al. | 156/169 |
| 3,737,359 | 6/1973 | Levitan | 156/555 |
| 3,767,510 | 10/1973 | Gustafson | 156/555 |
| 4,069,081 | 1/1978 | Drower et al. | 156/273.3 |
| 4,159,496 | 5/1979 | Swift | 361/1 |

OTHER PUBLICATIONS

"Getting Along with Your SE-LIN Book Labeler", published by Gaylord Bros., Inc., Mar., 1979.

*Primary Examiner*—Michael Wityshyn
*Attorney, Agent, or Firm*—Staas & Halsey

[57] ABSTRACT

An apparatus having a friction-feed and surface-driven roller mechanism for producing laminated labels from a strip of base-tape material and a strip of transparent overlay-tape material. The apparatus is readily mountable to and adapted for use with many different types of typewriters and printers without permanent modification thereto. One embodiment is adapted for use with a typewriter or printer having a rolling platen. Another embodiment is adapted for use with a printer having a fixed platen and sheet-feeding tractor mechanism. Yet another embodiment is adapted for use with a typewriter having a movable, rolling platen. In all embodiments, there is provided a roller mechanism having a frictionally surface-driven feed roller engaging either the typewriter platen or a separate drive roll for pulling the overlay-tape and base-tape material into and through the roller mechanism and pressing the adhesive surface of the overlay-tape material into contact with the base-tape material. In all embodiments, deformable drag discs are fixed on opposite sides of the base-tape material spool and locating and tensioning screws are attached to the base-tape material spool mounting assembly for both adjustably, laterally positioning the rotatably mounted base-tape material spool and adjustably contacting the deformable drag discs to apply tension against the base-tape material spool independent of the overlay-tape material spool in accordance with the required feeding and tracking controls of the base-tape material to the roller mechanism. The drag disks may be either insertable or integrally formed with said base-tape material spool.

39 Claims, 15 Drawing Figures

FIG. 1.
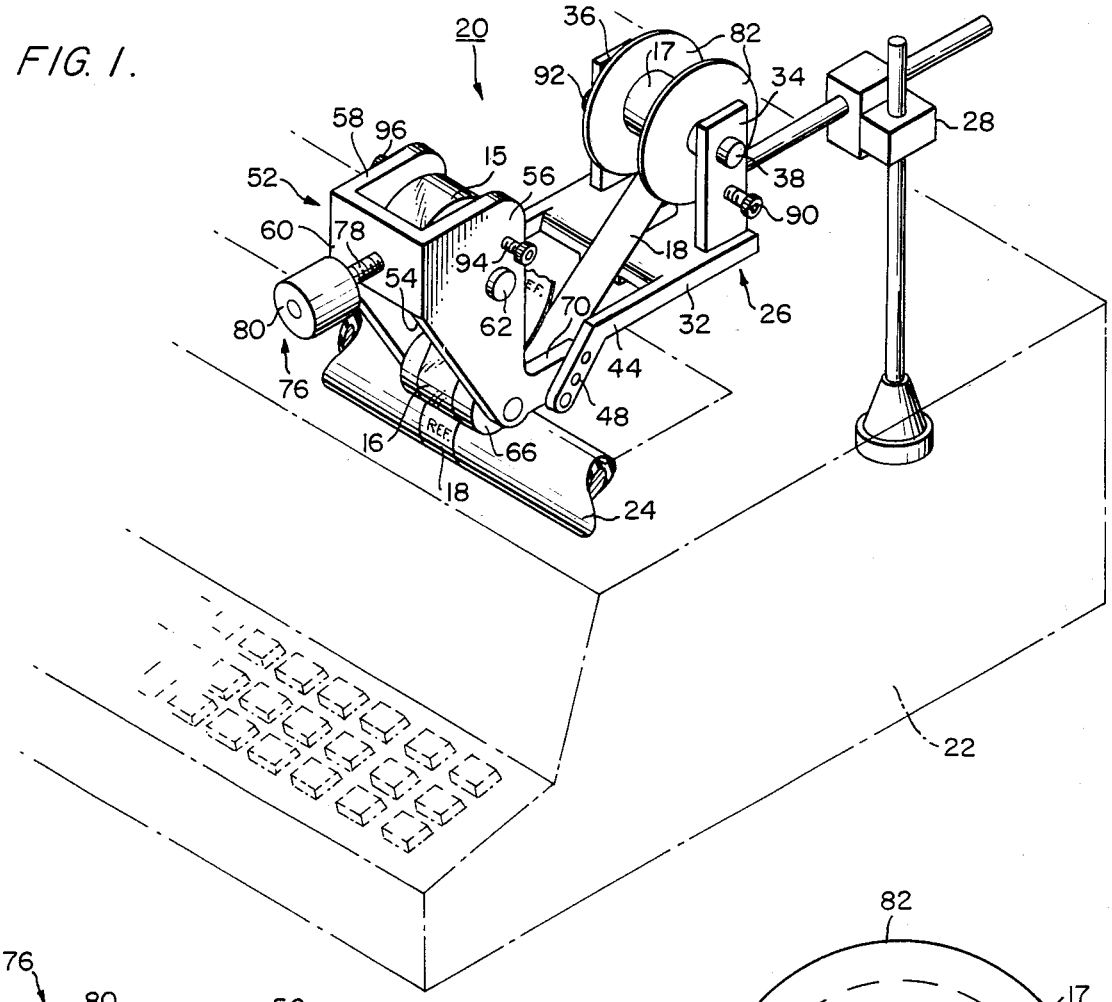
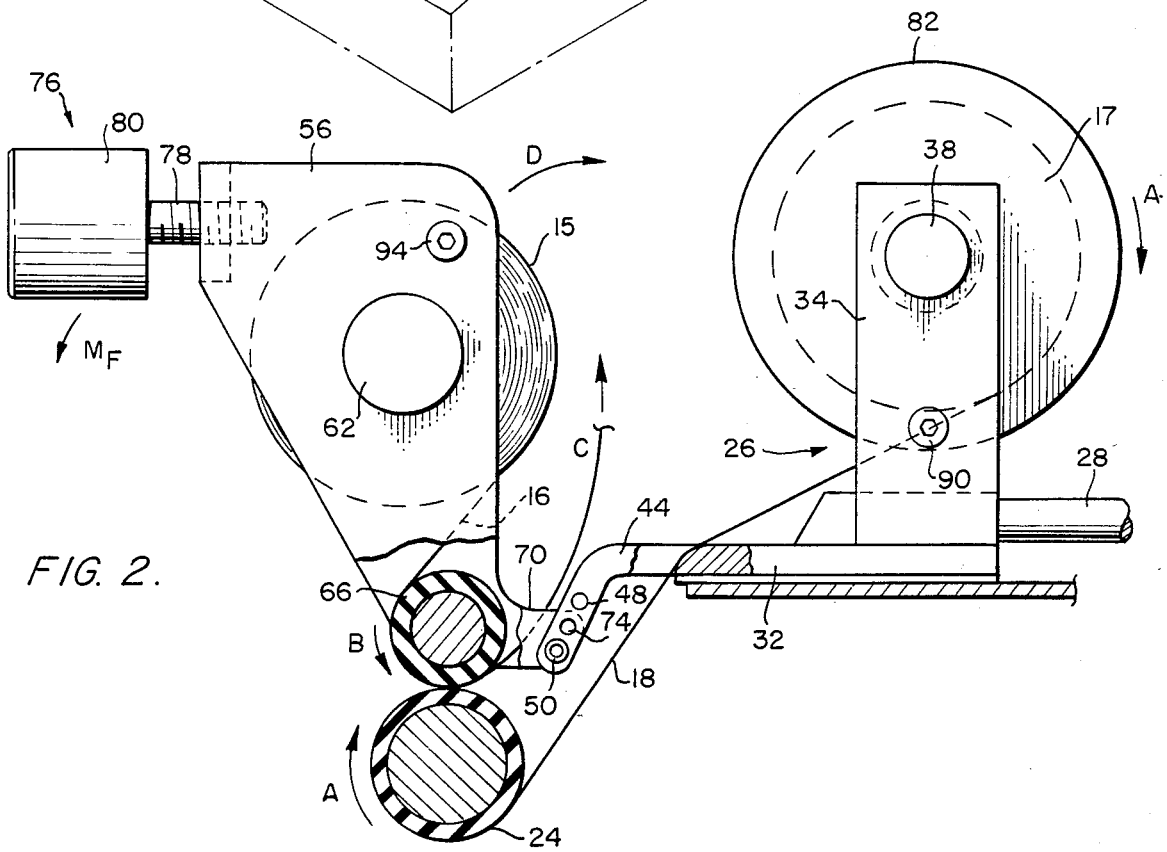
FIG. 2.

FIG. 5.
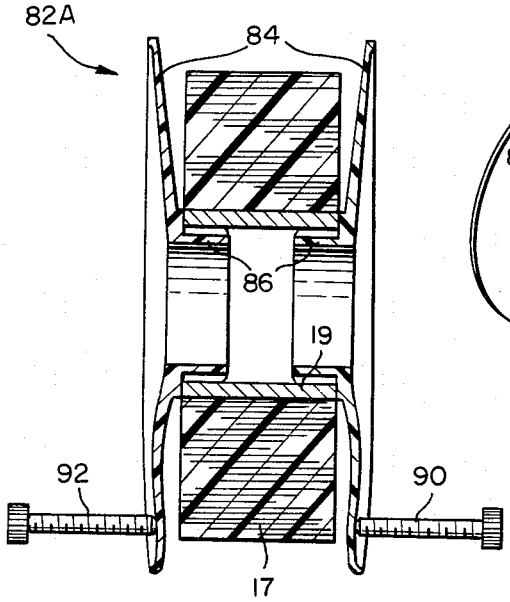
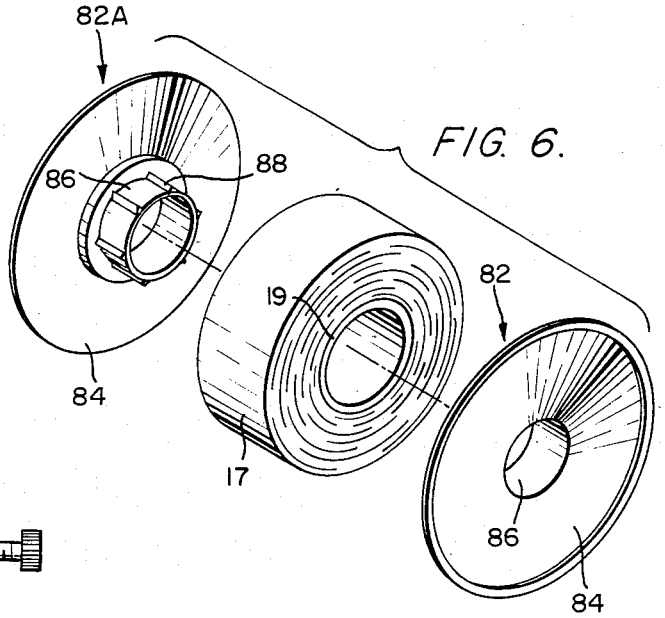
FIG. 6.
FIG. 7.
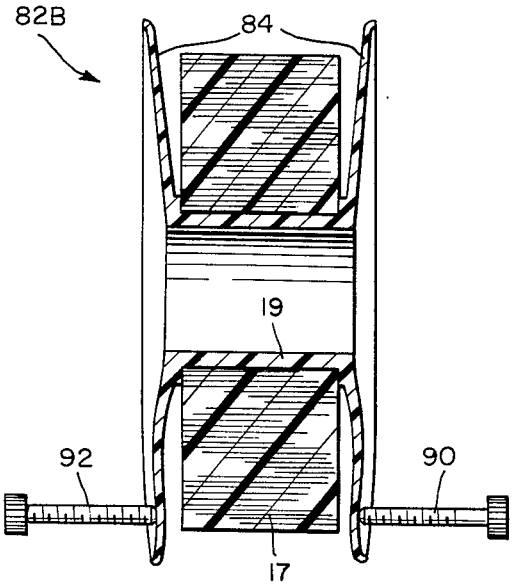
FIG. 8.
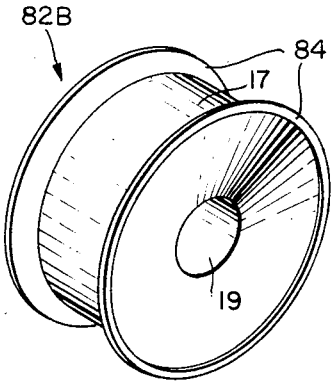

APPARATUS FOR PRODUCING LABELS

BACKGROUND OF THE INVENTION

This invention relates to an apparatus for producing labels, and, more particularly, to an apparatus having a friction-feed and surface-driven roller mechanism for producing the laminated labels that is readily mounted to and adapted for use with different types of typewriters and printers.

Laminated labels with printed indicia protected by a transparent cover have proven effective for various applications, e.g., the labeling of property such as library books and the like. Laminated labels and apparatus for producing such laminated labels for use with a typewriter having a rolling platen are described in U.S. Pat. No. 3,295,654 issued to Clinton et al. and assigned to American Library Association ("ALA").

As further described in the Clinton et al. U.S. patent, the laminated labels are formed from a strip of a base-tape material and a strip of overlay-tape material. The base-tape material has an adhesive coating on one surface with a protective backing strip in opposite relationship with the adhesive coating. The strip of overlay-tape material is transparent and has an adhesive coating on one surface. The known method of producing such laminated labels comprises the steps of printing the desired material on the surface of the strip of base material, placing the strip of transparent material onto the strip of base material with the adhesive coating adjacent the printed indicia, cutting the label from the combined strips of base material and transparent material, and removing the protective backing strip of the base material. The above type of laminated label material is currently marketed under the trademark SE-LIN® by Gaylord Bros., Inc., the assignee of the subject invention. Apparatus for producing such laminated labels formed from the base-tape and overlay-tape materials is discussed in the Clinton et al. U.S. patent and also is currently marketed by Gaylord Bros., Inc.

The state of the art since the 1960's has been to label-producing apparatus requiring use of a specially-made platen installed on a typewriter having gears formed thereon, and a corresponding metal roller acting against the platen and having gears formed thereon. The gears of the metal roller and the platen mesh with one another in such a manner that the metal roller is driven by the platen and the base-tape and overlap-tape materials are passed therebetween to form the laminated labels.

As again shown by reference to the Clinton et al. U.S. patent, the conventional label-producing apparatus is provided with a holder for rotatably supporting the spool of base-tape material and a holder for rotatably supporting the spool of overlay-tape material. The overlay-tape and base-tape spool holders are mounted between two similarly-shaped and parallely-arranged retainer plates. In the embodiment of this label-producing apparatus commercially marketed by Gaylord Bros., Inc., the assignee of the subject invention, one of the retainer plates is spring-loaded in the center thereof with the spring-load distributed or exerted against both the overlay-tape spool and the base-tape spool rotatably mounted between the two retainer plates. This mechanism provides tension on both spools as the base-tape and overlay-tape materials are supplied to the platen/-gear-driven feed roller mechanism. In addition, wax or paper discs are provided on opposite sides of the base-tape spool and overlay-tape spool to keep the retainer plates clean from adhesive of the tapes.

Despite the advantages of the label-producing apparatus described in the Clinton et al. U.S. patent and currently marketed by Gaylord Bros., Inc., this label-producing apparatus design suffers from a number of disadvantages in performance, reliability, versatility, and installation.

Firstly, it can be seen that the conventional label-producing apparatus is usable only on a basic typewriter having a rolling platen and requires a specially-made platen for installation to the particular typewriter. Thus, this conventional label-producing apparatus requires permanent modification and assembly to the typewriter.

Secondly, because of the use of a specially-made and installed platen and gear-driven feed roller, the conventional label-producing apparatus is not adaptable to all types of typewriters with rolling platens. For example, many typewriters have small platens and thus providing gears on the platens is difficult.

Thirdly, this conventional label-producing apparatus is not adaptable to printers with fixed or non-roller type platens, such as automated data terminal and computer printers using tractor mechanisms. Thus, the conventional apparatus is not suitable for automated processing of laminated labels for a significant commercial market now existing because of the advances in computer and printer technology.

Fourthly, the conventional label-producing apparatus suffers from certain disadvantages in performance in that there are both material misalignments and air pockets developed between the overlay-tape and base tape during lamination because of irregular feed through the roller assembly and/or irregularities in the surfaces of the platen or rollers.

Fifthly, the conventional label-producing apparatus has certain disadvantages in performance in that there is difficulty in alignment of the overlay-tape and base-tape materials between the rollers in the initial feeding stage.

Sixthly, the conventional label-producing apparatus suffers in performance and reliability in operation due to excessive drag on the overlay-tape and base-tape spools, wherein the accumulation of the spool drag and the drag inherent in the gear interchange between the platen and feed roller exceeds the drive capabilities of many electronic typewriters and small data printers.

Seventhly, even in the limited application to typewriters, the conventional label-producing apparatus requires from the standpoint of marketing and service requirements a large number of different components and multiple platens to accommodate the many different brands of typewriters.

In summary, the conventional label-producing apparatus suffers from a lack of reliable operation, a lack of quality lamination, a lack of versatility in applications to different types of typewriters and printers, and a lack of easy assembly and disassembly from the typewriters.

From the foregoing, it could be seen that an improved label-producing apparatus device is desired which is more reliable in operation, provides a higher quality lamination, is relatively simple in structure, is versatile and adaptable for use in many different types of typewriters and printers, and is easy to assemble and disassemble from the typewriter or printer.

SUMMARY OF THE INVENTION

Accordingly, it is an object of the present invention to eliminate the above-described problems of the conventional label-producing apparatus, yet maintain the advantages of producing such laminated labels.

It is another object of the present invention to provide a label-producing apparatus which has improved alignment and feeding capabilities and improved quality of the laminated labels.

It is another object of the present invention to provide a label-producing apparatus which is adaptable for use with many different types of typewriters and printers, including typewriters with a rolling platen, typewriters with a moving platen, printers with a fixed platen and sheet-feeding tractor mechanism, and printers with a rolling platen and tractor mechanism.

Yet another object of the invention is to provide a label-producing apparatus which is adaptable for use with data terminal and computer printers to allow automated processing capabilities for producing laminated labels.

It is another object of the present invention to provide a label-producing apparatus which requires no gear-driven roller assembly for producing the laminated label, thus eliminating permanent modification to the typewriter or printer with which the apparatus is to be used.

Another object of the present invention is to provide a label-producing apparatus which provides easy and quick assembly and disassembly from the typewriter or printer with which the apparatus is to be used.

It is another object of the present invention to provide a label-producing apparatus which is adaptable to typewriters and small data printers having low drive capabilities.

Yet another object of the invention is to provide a label-producing apparatus which has minimum mechanical drag to improve feed life for the typewriter or printer.

Yet another object of the present invention is to provide a label-producing apparatus having an improved base-tape material spool supply mechanism with independent and precise tension adjustment and tracking controls.

Another object of this invention is to provide a label-producing apparatus which has an improved base-tape and overlay-tape material supply mechanism having minimum hardware and easy adjustment controls for changes in the width of the base-tape and overlay-tape materials.

Additional objects and advantages of the invention will be set forth in part in the description which follows, and in part will be obvious from the description, or may be learned by practice of the invention. The objects and advantages of the invention may be realized and obtained by means of the instrumentality and combinations particularly pointed out in the appended claims.

To achieve the foregoing objects and in accordance with the purpose of the invention, as embodied and broadly described herein, there is provided an apparatus for producing laminated labels, used in combination with a typewriter or printer, comprising: (1) means for rotatably mounting a spool of transparent overlay-tape material having an adhesive surface; (2) means for rotatably mounting a spool of base-tape material having a printable surface and an opposite protected adhesive surface, the base-tape material mounting means including means for adjustably applying tension against the base-tape material spool independent of the overlay-tape material spool; (3) friction-feed, pressure-loaded roller means associated with the print head of the typewriter or printer for pulling the overlay-tape and base-tape materials into and through the roller means and pressing the adhesive surface of the overlay-tape material into intimate contact with the printable surface of the base-tape material, the friction and pressure-load of the roller means being operably adjustable; and (4) means for mounting the roller means adjacent the print head of the typewriter or printer.

A first embodiment of the apparatus is adapted for use with typewriters or printers having a rolling platen; a second embodiment is adapted for use with printers having a fixed platen and sheet-feed tractor mechanism; and a third embodiment is adapted for use with typewriters having a moving, rolling platen.

In the first embodiment of the apparatus, the means for rotatably mounting the base-tape material spool comprises a first mounting assembly either removably connected to the housing of the typewriter or printer or mounted externally from the typewriter or printer. The means for rotatably mounting the overlay-tape material spool and the means for mounting the roller means comprises a second assembly for mounting both the overlay-tape material spool and a frictionally surface-driven feed roller of the roller means which is pivotally connected to the first mounting assembly. A weight mechanism is connected to the second mounting assembly for providing a force through the feed roller against the typewriter platen as a result of the moment caused by the weight and distance of the weight to the pivotal connection of the second mounting assembly to the first mounting assembly. The weight mechanism is adjustable to vary the moment force of the feed roller against the platen.

In the second embodiment of the apparatus, the means for mounting the roller means and means for mounting the overlay-tape material spool comprises a first assembly for mounting both the overlay-tape material spool and roller means having a frictionally surface-driven feed roller and drive roller which is attachable to the tractor mechanism drive shaft. This first assembly is detachably mounted to the idle and drive shafts of the sheet-feeding tractor mechanism of the printer. The means for rotatably mounting the base-material spool comprises a second assembly for separately and detachably rotatably mounting the base-tape material spool to the inside of the printer housing and for supplying the base-tape material past the fixed platen of the printer. A spring means acts against the frictionally surface-driven feed roller for adjustably applying the friction-force and pressure-load of the feed roller against the drive roller.

In the third embodiment of the apparatus, the means for rotatably mounting the base-tape material spool, the means for rotatably mounting the overlay-tape material spool, and the means for mounting a frictionally surface-driven feed roller of the roller means, comprises a mounting assembly removably connected to the platen and carriage of the typewriter. The mounting assembly comprises a subassembly for rotatably mounting the overlay-tape material and the base-tape material spools having a support plate bracket, an outside plate retainer bracket which is removably positioned parallel to the support plate bracket, and spindles mounted to the support bracket and extending through the outside plate retainer bracket for rotatably mounting the overlay tape material spool and the base-tape material spool between the support plate bracket and the outside plate retainer bracket. The outside plate retainer bracket has stand-off legs extending from the retainer bracket for engaging the support bracket.

In all of the above embodiments of the apparatus, there are provided deformable drag discs attached on opposite sides of the base-tape material spool and adjustable locating and tensioning screw means attached to the base-tape material spool mounting assembly for laterally positioning the base-tape material spool on the spindle and for contacting the deformable drag discs to apply tension against the base-tape material spool independent of the overlay-tape material spool in accordance with the required operational feeding and tracking controls of the base-tape material to the roller means. In one embodiment for the drag discs, the drag discs are fixedly inserted into the base-tape material spool. In another embodiment of the drag discs, the drag discs are formed as an integral part of the spool for the base-tape material. The drag of the base-tape material is caused by the compression or deformation of the disc as the rotating disc runs over the adjustable tensioning screw means.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1 is a perspective view of a first preferred embodiment of the label-producing apparatus in accordance with the invention, this embodiment being adapted for use with a typewriter or printer having a rolling platen and illustrating in particular a mechanism for mounting the label-producing apparatus externally from the typewriter or printer;

FIG. 2 is a cross-sectional, cut-away view of the embodiment of the label-producing apparatus shown in FIG. 1;

FIG. 5 is a partial side view of one embodiment of the drag discs used with the base-tape material spool, illustrating in particular the deformation of the drag discs caused by the adjustable locating and tensioning screws of the invention;

FIG. 6 is a fragmented view of the embodiment of the deformable drag discs shown in FIG. 5, illustrating in particular the separate deformable drag discs which are fixedly inserted into the inner core of the base-tape material spool;

FIG. 7 is a partial side view of yet another embodiment of the drag discs used with the base-tape material spool, illustrating in particular the deformation of the drag discs caused by the adjustable locating and tensioning screw means of the invention;

FIG. 8 is a perspective view of the embodiment of the deformable drag discs shown in FIG. 7, illustrating in particular the integral structure of the deformable drag discs with the base-tape material spool;

DETAILED DESCRIPTION OF THE PREFERRED EMBODIMENTS

Reference will now be made in detail to the present preferred embodiments of the invention, examples of which are illustrated in the accompanying drawings.

Figure 13:
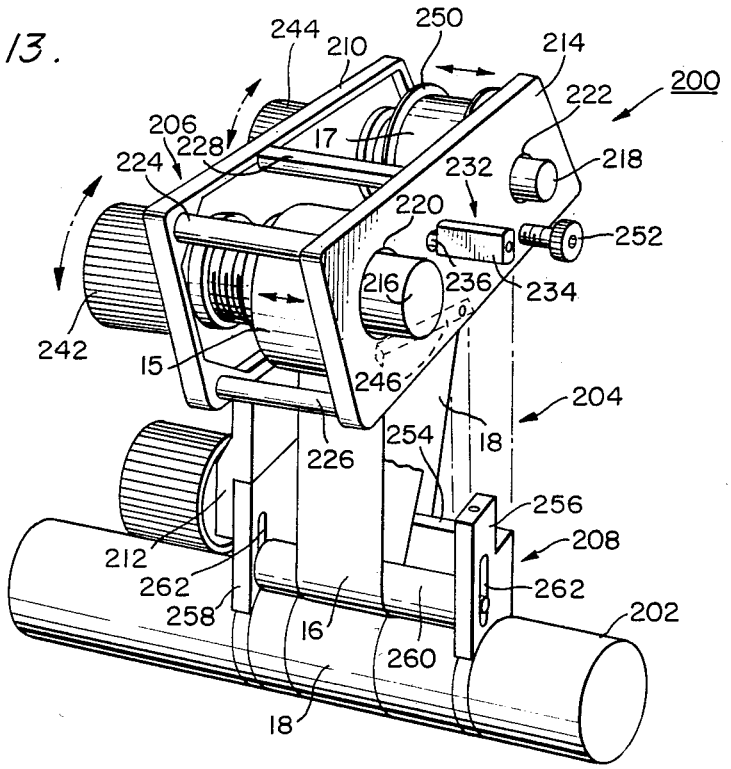
FIG. 13 is a perspective view of a third preferred embodiment of the label-producing apparatus in accordance with the invention, this embodiment being adapted for use with a typewriter having a moving, rolling platen, illustrating in particular the mounting assembly for the base-tape and overlay-tape material spools and frictionally surface-driven feed roller of the roller means.
Figure 14:
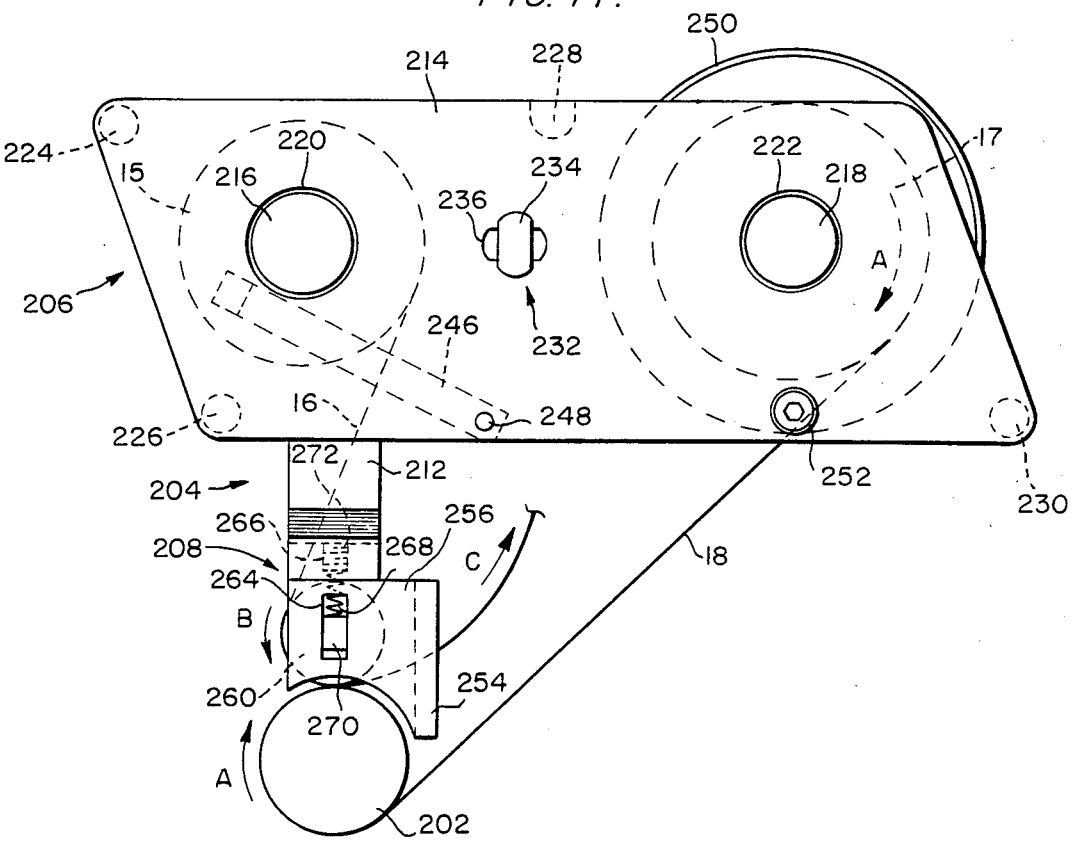
FIG. 14 is a side view of the embodiment of the label-producing apparatus shown in FIG. 13.
Figure 15:
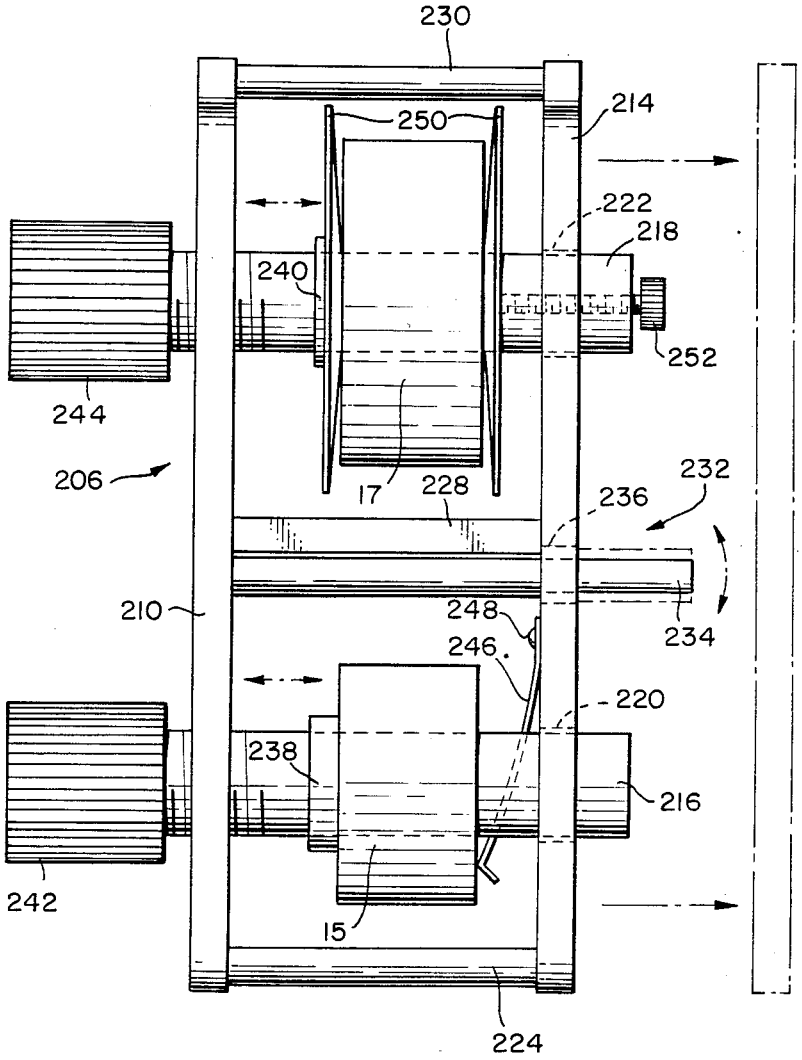
FIG. 15 is a top plan view of the embodiment of the label-producing apparatus shown in FIG. 13, illustrating in particular the detachable mounting of the outside plate retainer bracket of the subassembly for mounting the overlay-tape material and base-tape material spools.

In accordance with the invention, there are described hereinafter three preferred embodiments of an apparatus for producing laminated labels used in combination with a typewriter or printer. The first preferred embodiment of the label-producing apparatus described hereinafter is adapted for use with a typewriter or printer having a rolling platen, shown in FIGS. 1–4 and generally identified with reference numeral 20. The second embodiment of the label-producing apparatus described hereinafter is adapted for use with a printer having a fixed platen and sheet-feeding tractor mechanism, is shown in FIGS. 9–12 of the drawings, and is generally identified with reference numeral 100. The third embodiment of the label-producing apparatus described herein is adapted for use with a typewriter having a moving, roller platen, is shown in FIGS. 13–15, and is generally identified as reference numeral 200.

In all of the aforesaid embodiments, the apparatus in accordance with the invention includes (1) means for rotatably mounting a spool 15 of transparent overlay-tape material 16 having an adhesive surface; (2) means for rotatably mounting a spool 17 of base-tape material 18 having a printable surface and opposite protected adhesive surface, the base-tape material mounting means including means for adjustably applying tension against the base-tape material spool 17 independent of the overlay-tape material spool 15; (3) friction-feed, pressure-loaded roller means associated with the print heads of the typewriter or print head of the printer for pulling the overlay-tape and base-tape materials 16 and 18 into and through the roller means and pressing the adhesive surface of the overlay-tape material 16 into intimate contact with the printable surface of the base-tape material 18, the friction-force and pressure-load of the roller means being operably adjustable, and (4) means for mounting the roller means adjacent the print heads of the typewriter or print head of the printer.

As provided in all embodiments of the apparatus and as will be described further hereinafter, the roller means comprises a frictionally surface-driven, pressure-loaded roller acting against a drive roller which is either a separate drive roller or the platen of a typewriter or printer. In all embodiments, the means for adjustably applying tension against the base-tape material spool 17 comprises deformable drag discs fixed on opposite sides of the base-material spool and adjustable locating and tensioning screw means attached to the base-tape material spool mounting assembly for laterally aligning the base-tape material spool and for contacting the deformable drag disc to apply tension against the base-tape material spool, independent of the overlay-tape material spool and in accordance with the required operational feeding and tracking controls of the base-tape material to the roller means.

Figure 3:
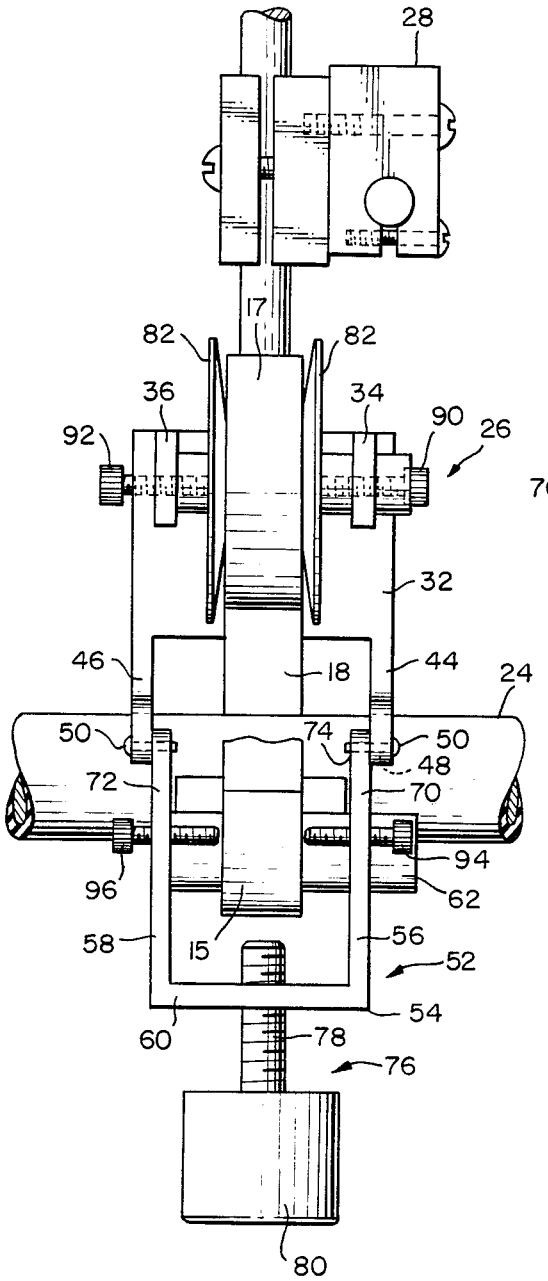
FIG. 3 is a top plan view of the embodiment of the label-producing apparatus shown in FIG. 1.
Figure 4:
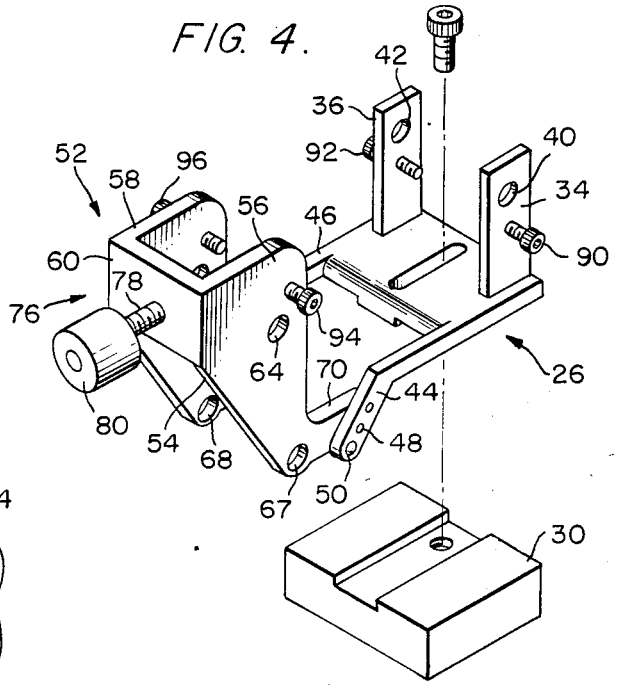
FIG. 4 is a fragmented view of the embodiment of the label-producing apparatus shown in FIG. 1, but with a mechanism for mounting the label-producing apparatus directly on the housing of the typewriter or printer.

With reference to FIGS. 1–4, the first embodiment of the label-producing apparatus 20 is adapted for use with a typewriter or printer having a rolling platen, such as typewriter 22 with conventional platen 24. In this embodiment, the means for rotatably mounting the base-tape material spool comprises a first mounting assembly 26 which is either removably connected to the housing of the typewriter or printer, or mounted externally away from the typewriter or printer. For example, as illustrated in FIG. 1, the first mounting assembly 26 includes a mounting mechanism which is a mounting stand 28 to which the base-tape material spool mounting assembly 26 is attached. The mounting stand 28 is located on the table on which the typewriter or printer is positioned in a manner for providing rigid support to the assembly 26. The stand 28 contains vertical, horizontal and angular adjustability for proper location of the assembly 26 over the upper portion of the typewriter housing, as illustrated in FIG. 1. Alternatively, and as illustrated in FIG. 4, the mounting mechanism is a mounting block 30 for attaching the assembly 26 to the rear portion of the typewriter or printer housing by epoxy, double-faced tape or the like. As illustrated in FIG. 4, the mounting block 30 has a corresponding dovetail mounting arrangement between the block and assembly and an adjustable slot and screw arrangement between the block and assembly for connecting the two components and adjusting the location of the assembly to the typewriter platen 24. The block 30 should be mounted on the typewriter at an appropriate location which will not interfere with normal typewriter or printer paper operation. Different mounting blocks 30, moreover, can be used to accommodate different brands of typewriters and printers.

In both embodiments of the mounting mechanism, the base-tape mounting assembly 26 should be located as illustrated in FIGS. 1 and 2 where the assembly 26 is adjacent the platen 24 of the typewriter so that the base-tape material 18 is fed along the path shown by arrow A underneath and around the platen 24.

As embodied herein, the mounting assembly 26 further comprises a base support member 32 having the configuration shown in FIGS. 1, 2 and 4. Vertical supports 34 and 36 are attached to the rear portion of the base support member 32 extending upwardly for rotatably-mounting the base-material spool 17. More specifically, a spindle 38 is provided between the vertical support arms 34 and 36 and mounted to the vertical support arms 34 and 36 at the ends thereof through holes 40 and 42 formed in the respective vertical supports as shown in FIG. 4. The spool 17 of the base-tape material is rotatably mounted on the spindle 38, as depicted in FIGS. 1 and 2.

As further illustrated in FIGS. 1, 2 and 4, the base support member 32 has a pair of L-shaped arms 44 and 46 extending from the front portion thereof toward the platen 24 of the typewriter. At the ends of the L-shaped arms 44 and 46 facing the typewriter platen 24, there are formed therein through holes 48 for receiving pivoting pins 50 and thus pivotally attaching a second mounting assembly of the apparatus as will be described hereinafter. A plurality of pivoting holes 48 are provided preferably to allow different pivotal mounting locations of the second mounting assembly to the first mounting assembly of the apparatus for fitting different types of typewriters and printers. The length of the base support member 32 is such that the L-shaped arms 44 and 46 would be positioned adjacent the platen 24 of the typewriter printer, with the angle of the L-shaped arms 44 and 46 to the member 32 being approximately 120°. To fit the arms 44 and 46 downwardly into the opening of the typewriter or printer, the location of the assembly 26 can be adjusted by the detachable mounting of the base support member 32 to the mounting stand 28 or mounting block 30 as described earlier.

In the first embodiment of the label-producing apparatus illustrated in FIGS. 1–4, the means for rotatably mounting the overlay-tape material spool and the means for mounting the roller means comprises a second mounting assembly 52 for mounting both the overlay-tape material spool 15 and the frictionally surface-driven feed roller of the roller means. This second mounting assembly 52 is pivotally connected to the first mounting assembly 26 and has a configuration and structure as best seen in FIGS. 1, 2, 3 and 4.

More specifically, the second mounting assembly 52 has a U-shaped frame support member 54 having side sections 56 and 58 and a front section 60. Between the side sections 56 and 58 of the U-shaped member 54, there is rotatably mounted the overlay-tape material spool 15. That is, a spindle 62 is mounted at each end thereof through holes 62 formed in the central area of the respective side sections 56 and 58. The overlay-tape material spool 15 is then rotatably mounted on the spindle 62 for feeding of the overlay-tape material 16 toward the platen 24 of the typewriter as shown by arrow B in FIG. 2.

In the first embodiment of the label-producing apparatus as illustrated in FIGS. 1–4, the drive roller of roller means comprises the conventional platen 24 of the typewriter or printer. The frictionally surface-driven pressure-loaded roller of the roller means comprises a frictionally, surface-driven feed roller 66 which is rotatably mounted at the lower end of the U-shaped support member 54 between the side sections 56 and 58 as best illustrated in FIGS. 1 and 2 for engaging the platen 24. The feed roller preferably has an approximately one-inch cross-sectional diameter and comprises an inner metal shaft and an outer surface of a natural rubber of approximately 50 durometers. The shaft ends of the feed roller 66 are rotatably mounted in holes 67 and 68 formed at the lower ends of the respective side sections 56 and 58 of the U-shaped support member 54 using bearings or the like.

As embodied herein and as shown in FIGS. 1–4, the second mounting assembly 52 has a pair of short legs 70 and 72 extending from the lower rear area of the side sections 56 and 58 of the bracket 54. The legs 70 and 72 have one or more through holes 74 formed thereon that are compatable with the holes 48 formed in the L-shaped arms 44 and 46 of the first mounting assembly 26. The short legs 70 and 72 are positioned inwardly of the L-shaped arms 44 and 46 such that the second mounting assembly 52 is pivotally mounted to the first mounting assembly 26 by placing the pivoting pins 50 through the corresponding holes 48 of the first mounting assembly and the holes 74 of the second mounting assembly. With the foregoing construction, the second mounting assembly 52, with the feed roller 66 and overlay-tape material spool 15 can be moved away from the platen 24 of the typewriter for initial alignment and feeding of the overlay-tape and base-tape materials 16 and 18 as will be described hereinafter. During laminating operations, however, the feed roller 66 and the platen 24 of the typewriter pull the overlay-tape material 16 and the base-tape material 18 into and between the feeder roller 66 and the platen 24 of the typewriter and press the adhesive surface of the overlay-tape material into intimate contact with the printable surface of the base-tape material to form a laminated label strip feed outwardly as best seen in FIG. 2 and indicated by arrow C.

As also can be seen by reference to FIGS. 1–4, the first embodiment of the label-producing apparatus further includes a weight mechanism 76 connected to the second mounting assembly 52 for providing a force of the feed roller 66 against the platen 24. This is a result of the moment force, depicted by arrow MF in FIG. 2, caused by the weight and distance of the weight to the pivotal connection of the second mounting assembly 52 to the first mounting assembly 26. The weight mechanism 76 is adjustable to vary the moment force of the feed roller against the platen. As embodied herein, the weight mechanism 76 comprises a threaded rod 78 which is threadedly attached through a threaded hole formed in the front section 60 of the U-shaped support member 54 of the second mounting assembly 52. At the other end of the rod 78, a weight 80 is either fixed to the threaded rod 78 or threaded to the end of the rod 78 in such a manner as to allow different weights to be attached to the rod 78. The distance between the weight 80 and the pivoting point of the second mounting assembly 52 to the first mounting assembly thus can be adjusted to vary the moment force MF being applied through the feed roll 66 against the platen 24 of the typewriter.

In order to provide optimum tracking control and feeding of the base-tape material 17 into and through the feed roller 66 and the platen 24, the label-producing apparatus in accordance with the invention further includes means for adjustably applying tension against the base-tape material spool 17 independent of the overlay-tape material spool 15. This is a significant component of the label-producing apparatus in order to allow the precise feeding of the materials through the roller assembly. By doing so, the label-producing apparatus can be utilized on many different types of typewriters or printers, particularly electronic typewriters and small printers which have low drive capabilities and require optimum feeding control and tracking requirements to properly perform the lamination operation.

With further reference to FIGS. 3–8, the means for adjustably applying tension against the base-tape material spool in apparatus 20 comprises deformable drag discs 82 fixed on opposite ends of the base-material spool 17. As one embodiment of the drag discs 82, there is provided the drag disc 82A formed of a deformable plastic which is fixedly insertable into the end of the base-tape material spool 17 as illustrated in FIGS. 5 and 6. The drag disc 82A has a sidewall 84 and a circular cap 86 projecting from the sidewall 84 which is insertable into the center core 19 of the base-material spool 17. Preferably, locking tabs 88 are formed on the outer circumference of the cap 86 for engaging the inner surface of the base-tape material spool 17 and thus fixedly securing the disc 82A to the spool 17. Adhesive may be provided on the locating tabs 88 for bonding the inner surface of the base-material spool and thus ensure that the drag disc 82A is fixedly secured to the base-tape material spool 17. The side wall 84 of the disc 82A extends slightly laterally outwardly from the center portion near the cap 86 to the outer circumferential portion of the disc to allow for deformation without interfering with the unwinding of the base-tape material 18 from the spool 17. The side walls 84 also limit lateral material movement and adhesive flow outside the disc. The angle of the outwardly extending sidewall of the disc is approximately 5°–10°.

An alternative embodiment of the drag disc 82 is illustrated in FIGS. 7 and 8 as disc 82B. As embodied therein, the drag disc 82B is formed as an integral part of the base-tape material spool 17, thus eliminating the need for the projecting cap and locking tabs, and the insertion step of the disc into the base-tape material spool. The drag disc 82B, however, would have the same angled side wall 84 as described with respect to the disc 82A embodiment shown in FIGS. 5–6 to allow proper unwinding of the base-tape material 18.

In conjunction with the deformable drag discs 82, the means for adustably applying tension against the base-tape material spool 17 further comprises adjustable locating and tensioning screw means attached to the mounting assembly 26 for laterally aligning the spool 17 and for contacting the deformable drag disc 82 to apply tension against the base-tape material spool 17 independent of the overlay-tape spool 15. As embodied herein, the adjustable locating and tensioning screw means includes a pair of screws 90 and 92 threadably mounted through respective holes formed in the vertical supports 34 and 36 of the first mounting assembly 26, as best seen in FIGS. 1–2 and 4. The screws 90 and 92 are adjustable against the side walls 84 of the corresponding deformable drag discs 82 for applying a tension against the base-tape material spool 17 in accordance with the required operational feeding and tracking controls of the base-tape material 18 to the feed roller 66 and platen 24. Preferably, the screws 90 and 92 are mounted on the vertical supports 34 and 36 for contacting the side walls 84 of the drag discs 82 at the outer circumference area thereof and to deform the drag disc 82 in the manner illustrated in FIGS. 5 and 7. The angle of the side wall 84 from the spool 17 allows for deformation of the drag disc without interfering with the unwinding of the base-tape material. Since the screws 90 and 92 may cause wear on the discs 82, it is preferable to replace the drag discs 82 as provided for in the embodiment of the drag discs 82A of FIGS. 5 and 6, or to provide the drag disc 82B of FIGS. 7 and 8 as an integral part of the spool 17 so that each base-tape material spool 17 is provided with new drag discs.

With the foregoing construction of the discs 82 and screws 90 and 92, a precise, reliable torque can be exerted on the base-tape material spool by fine or minute adjustability of the screws against the disc. This allows for setting the least drag required in the tracking control and feeding operation of the base-tape material to the roller assembly for the particular typewriter or printer involved.

As embodied herein, and in order to ensure proper feeding alignment of the overlay-tape material 16 from spool 15 in the second mounting assembly 52 to the roller assembly, screws 94 and 96 are threadably mounted in through holes formed on the side sections 56 and 58 of the U-shaped support member 54 as illustrated in FIGS. 1, 3 and 4. This allows for independent alignment of the overlay-tape material spool 15 in relationship to the independent alignment and tensioning of the base-tape material spool 17. The above type of construction eliminates or reduces unnecessary drag against the overlay-tape material since drag is already provided by the adhesive surface of the clear-tape material during operation. This construction also provides for fine drag tuning of the base-tape material to further reduce any unnecessary drag on the base-tape spool 17.

The overall construction of the first embodiment of the invention achieves a label-producing apparatus 20 which is more reliable in operation, provides a higher quality lamination, is relatively simple in construction, is versatile and adapted for use in many different types of typewriters and printers and is easy to assemble and disassemble from the typewriter or printer. This label-producing apparatus 20 requires no permanent modification to the typewriter or printer and allows it to be used with typewriters and small data printers which have low drive capabilities not heretofore achieved.

The apparatus 20 requires only one open space in the typewriter or printer platen area and clearance for the second pivoting assembly 52. The apparatus 20 can be mounted using a simple block 30 either to the typewriter or printer, or can be mounted externally from the typewriter or printer using a stand 28. The apparatus, when not being used, simply can be removed from the typewriter or printer to allow full width use of the normal paper capabilities of the typewriter or printer. This apparatus also eliminates the need for special part stocking, machining and other factory adjustment or handling of the specific typewriters or printers of the customer. Finally, with use of the pivotally-connected second mounting assembly 52 and the frictionally surface-driven, pressure-loaded feed roller 66, the initial alignment and feeding operations for placing the overlay-tape material and base-tape material together for subsequent feeding and laminating of the labels is expedited and improved. Use of the frictionally surface-driven, pressure-load roller 66 also improves the laminating operation being performed. More specifically, the roller 66 eliminates both material misalignments and air pockets developed between the overlay-tape and base-tape materials during lamination because of irregular feed through the roller assembly and irregularities in the surface of the conventional typewriter platen. Eliminating the air pockets also prevents ink from spreading on the base-tape material immediately after the printing thereon by the print heads of the typewriter.

With reference to FIGS. 9–12, the second preferred embodiment of the label-producing apparatus 100 is adapted for use with a printer having a fixed platen 102, a print head 104 associated therewith, and a sheet-feeding tractor mechanism 106, such as that used in printing of continuous forms in computer printers or data terminal printers. Conventionally, the sheet-feeding tractor mechanism 106 includes a drive shaft 108 and an idle shaft 110.

In this second embodiment of the apparatus 100, the means for rotatably mounting the roller means and means for mounting the overlay-tape material spool comprises a first mounting assembly 112 for mounting both the overlay-tape material spool and roller means which is detachably mounted to the idle shaft 110 and drive shaft 108 of the tractor mechanism 106 of the printer.

Figure 9:
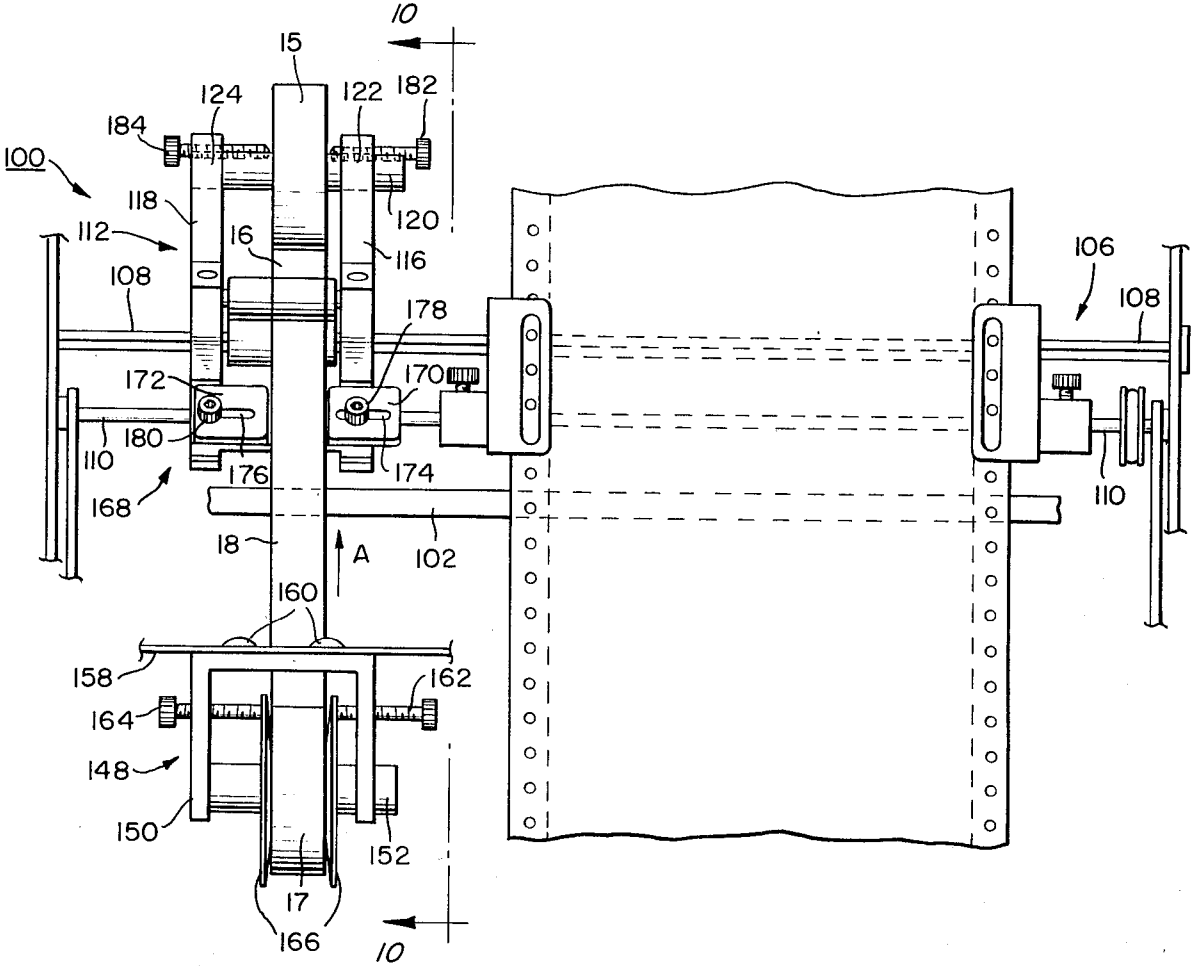
FIG. 9 is a schematic front view of a second preferred embodiment of the label-producing apparatus in accordance with the invention, this embodiment being adapted for use with a printer having a fixed platen and a sheet-feeding tractor mechanism.
Figure 10:
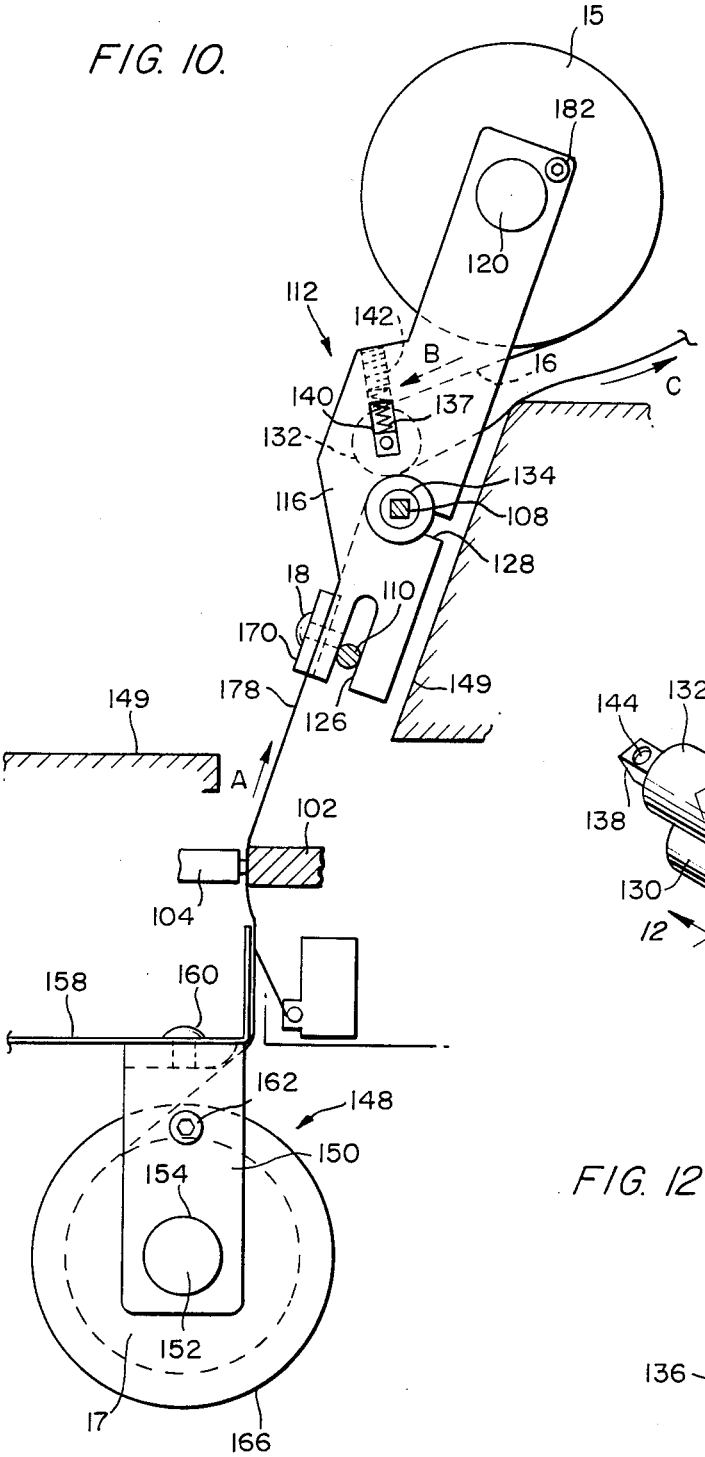
FIG. 10 is a schematic partial side view of the embodiment of the label-producing apparatus shown in FIG. 9, taken along the line 10—10 of FIG. 9, illustrating in particular the location of the first assembly for mounting the overlay-tape material spool and the friction-feed, pressure-loaded roller means in relationship to the idle and drive shafts of the sheet-feeding tractor mechanism of the printer and the means for rotatably mounting the base-tape material spool in relationship to the fixed platen and print head of the printer.
Figure 11:
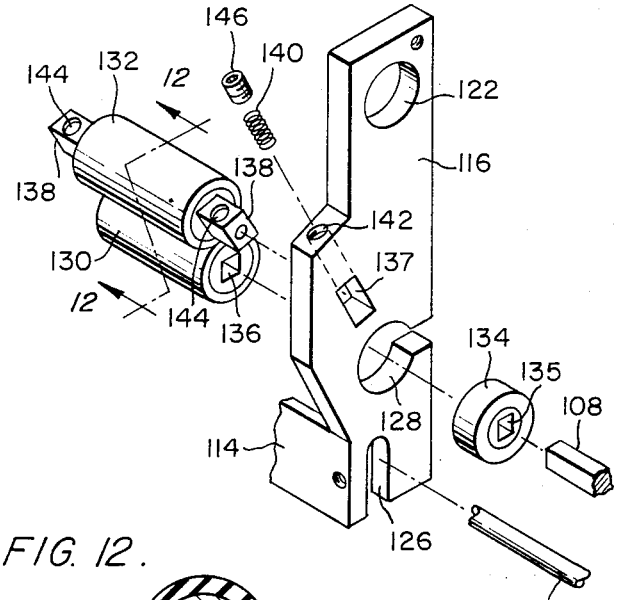
FIG. 11 is a partial fragmented view of the assembly of the roller means and overlay-tape material spool spindle to one side support plate of the first mounting assembly which is detachably connected to the idle and drive shafts of the sheet-feeding tractor mechanism of the printer.

The first mounting assembly 112 includes a frame 114 having side support arms 116 and 118 having the configuration as specifically shown in FIGS. 9–11. A spindle 120 is provided between the side support arms 116 and 118 and has ends mounted to the side arm supports 116 and 118 through holes 122 and 124 formed in the respective side support arms 116 and 118 in the upper portion thereof as shown in FIGS. 10–11. The overlay-tape material spool 15 is rotatably mounted on the spindle 120.

As further illustrated in FIGS. 10–11, the side support arms 116 and 118 have at the lower end thereof respective elongated open-ended slots 126 and in the middle portion thereof holes 128 with an elongated slot extending to the rear side of the support arms. The elongated slots 126 and holes 128 can be detachably mounted respectively to the idle shaft 110 and the drive shaft 108 of the sheet-feed tractor mechanism 106 of the printer, as illustrated in FIG. 10. It can be appreciated that this detachable mounting and dismounting of the first mounting assembly 112 can be achieved on most sheet-feeding tractor mechanisms for printers, without concern for whether the drive shaft and idle shaft are reversed in location. The attachments for the first mounting assembly 112 can be easily interchangeable to allow universal applicability.

Figure 12:
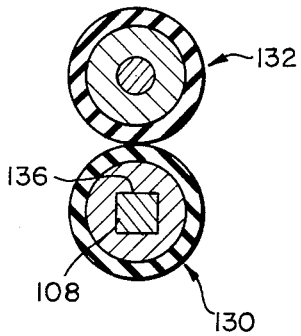
FIG. 12 is a cross-sectional view of the frictionally surface-driven feed roller and drive roller of the roller means, taken along the line 12—12 of FIG. 11, for the second embodiment of the label-producing apparatus shown in FIGS. 9–11.

In this second embodiment of the apparatus 100 and as further illustrated by FIGS. 10–12, the roller means comprises a separate drive roller 130 and a frictionally surface-driven pressure-loaded roller 132 acting against the drive roller 130, both of which are rotatably mounted to the first mounting assembly 112 between the side support arms 116 and 118. Preferably, the drive roller has an outer surface formed of an approximately 50 durometer natural rubber and the frictionally surface-driven roller 132 is also formed with at least an outer surface of an approximately 50 durometer natural rubber. Both rollers preferably have an outer diameter of approximately one inch. However, the roller diameters can be varied depending upon the required usage.

Since this apparatus 100 is adapted for use with a printer having a fixed platen 102, there is provided the separate drive roller 130 which is mounted between the side support arms 116 and 118. As can be further seen from FIGS. 11 and 12, bearings 134 fit into the respective holes 128 of the side arms 116 and 118 and have an inner square hole 135 to rotatably receive and support the square drive shaft 108 of the tractor mechanism. The bearings 134 can be held in position by suitable retainer rings or the like. The drive roller 130 is provided with a center square through hole 136 for engaging the square drive shaft 108. During operation, the tractor mechanism drive shaft 108 drives the drive roller 130. As further illustrated in FIGS. 10–11, the side support arms 116 and 118 have rectangular through holes 137 formed in the middle portion thereof at an approximately 60° angle to the holes 128 for rotatably receiving the frictionally surface-driven roller 132. More particularly, the roller 132 is provided with shaft ends which are received in block-like bearings 138, the bearings 138 being slidably insertable into the holes 137 and held in position by suitable retainer rings or the like. With the arrangement as described above, the frictionally surface-driven roller 132 engages the drive roller 130 receiving therebetween the overlay-tape material 16 and the base-tape material 18 which are fed respectively from the spools 15 and 18. The overlay-tape material 16 is fed to the rollers 130 and 132 from the spool 15 as shown in FIG. 10 and indicated by arrow B.

In accordance with the invention, the label-producing apparatus 100 further comprises means operable adjustable for varying the friction-force and pressure-load of the feed roller 132 against drive roller 130. As embodied herein, and as shown in FIGS. 10–11, the ajustable means includes springs 140 which are insertable into holes 142 formed in side support arms 116 and 118. One end of the spring 140 is received in a locating hole 144 in the bearing 138. A screw 146 is threadably received into each of the holes 142, acts against the other end of the spring 140, and is adjustable for varying the biasing force of the spring 140 against the bearing 138 connected to the end of the feed roller 132. As can be seen from the use of the screws 146 and springs 140, the friction-force and pressure-load of the feed roller 132 can be very finely adjusted in accordance with the required operational feed of the base-tape material and overlay-tape material through the rollers 130 and 132.

With the above construction for the aforesaid first mounting assembly 112, the assembly 112 can be easily mounted and dismounted from the sheet-feeding tractor mechanism of the printer. This first mounting assembly 112 requires no permanent modification to the sheet-feeding tractor mechanism of the printer or the printer itself and does not interfere with the normal printing functions. In addition, the drive and feed roller mechanism allows for material thickness to vary and some slight angular slip, yet assuring straight feed of the overlay-tape material 16 and the base-tape material 18 through the roller mechanism.

In this second embodiment of the label-producing apparatus 100 and as best seen in FIG. 10, the means for rotatably mounting the base-material spool 17 comprises a second assembly 148 which separately and detachably mounts the base-tape material spool 17 to an inner portion of the printer housing 149 and supplies the base-tape material 18 past the fixed platen 102 of the printer for printing by the printer head 104. More specifically, the second mounting assembly 148 includes a U-shaped bracket support member 150 having a configuration shown in FIG. 9. A spindle 152 is provided between the bracket 150 and has ends mounted to the bracket through holes 154 formed in the bracket as shown in FIG. 10. The spool 17 of the base-tape material is rotatably mounted on the spindle 152, as depicted in FIGS. 9 and 10. The U-shaped support member 150 is removably connected inside the printer housing 149, such as on the lower printer pan 158, to allow feeding of the base-tape material 18 from the spool 17 to the fixed platen 102 for printing of the material 18 by the print head 104 of the printer, as best shown in FIG. 10. The path of base-tape material 18 is indicated by arrow A. The U-shaped support member 150 is suitably attached to the lower pan 158, such as by double-sided tape, epoxy or by bolts 160 as illustrated in FIGS. 9 and 10.

In accordance with the invention, the second embodiment of the label-producing apparatus further comprises means for adjustably applying tension against the base-tape material spool independent of the overlay-tape material spool. The adjustable tension means in apparatus 100 comprises components similar to those of the first embodiment of the apparatus 20. That is, tensioning screws 162 and 164 are threadably mounted to the U-shaped support member 150 for acting against deformable drag discs 166 fixed on opposite sides of the base-tape material spool 17. The drag disc 166 is of a similar configuration as drag disc 82 depicted in FIGS. 5–8 for apparatus 20. The operation of the tensioning screws 162 and 164 against the drag discs 166 is also similar and therefore not described further herein. Of course, in addition to providing the tensioning against the base-tape material spool 17 for the required operational tracking and feeding control of the base-tape material to the rollers 130 and 132, the tensioning screws 162 and 164 also serve to laterally align the base-tape material spool 17 on the spindle 152 for proper alignment feeding to the fixed platen 102 and to the rollers 130 and 132 as indicated by arrow A in FIG. 10.

To further ensure proper feeding alignment of the base-tape material 18 to the rollers 130 and 132, the label-producing apparatus 100 further includes a guiding mechanism 168 which is connected to the first mounting assembly 112 for guiding the base-tape material 18 from the fixed platen 102 of the printer to the drive and feed rollers 130 and 132. As embodied herein and as best seen in FIGS. 9 and 10, the guiding mechanism 168 comprises a pair of brackets 170 and 172 having elongated slots 174 and 176. The guide brackets 170 and 172 are respectively mounted to the side support arms 116 and 118, using screws 178 and 180 which pass through the elongated slots 170 and 176 and which are threadably connected to the side support arms 116 and 118. The brackets 170 and 172 can be adjusted laterally and tightened in position by the screws 178 and 188 acting against the brackets 170 and 172, as shown in FIGS. 9 and 10.

In addition to the guiding mechanism 168 for aligning the feed of the base-tape material 18 to the rollers 130 and 132, the label-producing apparatus 100 further includes adjustable locating screws 182 and 184 for laterally aligning the overlay-tape material spool 15 on the spindle 120 and the feed of the overlay-tape material 16 to the rollers 130 and 132. The locating screws 182 and 184 are threadably mounted to the respective side support arms 116 and 118 through holes 186 formed in the upper portion of the side support arms 116 and 118, as best shown in FIGS. 10 and 11.

With the foregoing construction for the label-producing apparatus 100, a label-producing apparatus is available which is readily adaptable to an automated printer having a fixed platen and a sheet-feeding tractor mechanism. With adaptation of such an apparatus to a computer printer, automated production of laminated labels can now be achieved. Both the mounting assemblies 112 and 148 of the apparatus 100, moreover, are detachably mounted and dismounted from the sheet-feeding tractor mechanism and the housing of the printer without permanent modification to the printer and interference with normal sheet-feeding operation of the printer. The independent adjustable drag on the base-tape material spool, the tension caused by the adhesive of the overlay-tape material, and the independent alignments for the base-tape material and overlay-tape material will ensure proper feeding of the materials into and through the drive roller 130 and feed roller 132 to form a strip of laminated labels as indicated by arrow C. With the roller mechanism as described, an improved lamination operation is achieved. In summary, the second embodiment of the invention provides for an improved label-producing apparatus 100 which is more reliable in operation, provides a higher quality lamination, is relatively simple in construction, is versatile and adapted for use in many different types of printers, and is easy to assemble and disassemble from the printer.

With reference to FIGS. 13–15, the third preferred embodiment of the label-producing apparatus 200 is adapted for use with a typewriter having a moving, rolling platen 202. In this embodiment, the means for rotatably mounting the base-tape material spool, the means for rotatably mounting the overlay-tape material spool, and the means for mounting the roller means comprises a mounting assembly 204 having a first subassembly 206 for rotatably mounting both the overlay-tape material spool 15 and the base-tape material spool 17, and a second subassembly 208 for mounting the frictionally surface-driven feed roller of the roller means.

As embodied herein, the first subassembly 206 has a configuration and structure as best seen in FIGS. 13–15. More specifically, the first subassembly 206 has a support plate bracket 210 mounted to a main frame 212 of the overall assembly 204. An outside plate retainer bracket 214 is removably positioned parallel to the support plate bracket 210. A pair of spindles 216 and 218 are mounted to the support plate bracket 210 and extend through the outside retainer plate bracket respectively through holes 220 and 222 formed in the outside retainer plate bracket 214 as best seen in FIGS. 13–15. The overlay-tape material spool 15 and the base-tape material spool 18 are respectively rotatably mounted on the spindles 216 and 218 for feeding of the overlay-tape material 16 and the base-tape material 18 to the roller means of this third embodiment of the label-producing apparatus 200 as will be described hereinafter.

As embodied herein, the outside retainer plate bracket 214 has four stand-off legs 224, 226, 228 and 230 projecting outwardly from the inner side wall portion of the retainer plate bracket 214 for engaging the support plate bracket 210, as best seen in FIGS. 13 and 15. A locking assembly 232 for the outside retainer plate bracket comprises a locking rod 234 extending through the locking rod hole 236 formed in the middle portion of the outside retainer plate bracket 214. The rod 234, when turned, will lock the outside retainer plate bracket 214 into position with the stand-off legs 224, 226, 228 and 230 engaging the support plate bracket 210.

As embodied herein, locating means is provided near the ends of the spool spindles 216 and 218 adjacent the support plate bracket 210 for laterally locating the overlay-tape material spool 15 and the base-tape material spool 17 on the respective spindles 216 and 218. Preferably, this locating means comprises forming a shouldered spindle which shoulder would abut the end of the spool facing the support plate bracket 210. Alternatively, a retainer ring or other locating mechanism could be provided on the spindles 216 and 218. To adjust the lateral location of the locating shoulders 238 and 240, respectively, of the spindles 216 and 218, the spindles are threadably mounted to the support plate bracket 210 with adjusting knobs 242 and 244 provided at the ends of the spindles 216 and 218 extending outside the support plate bracket 210. The spindles are therefore independently adjustable by rotating either spindle at right-hand side thereof to laterally locate either the locating shoulder 238 or 240 of the spindle 216 or 218. Proper alignment of the feeding of the overlay-tape material 16 from spool 15 and the base-tape material from spool 17 can be achieved. Locking knobs 242 and 244 are used to lock respectively spindles 216 and 218 in pre-adjusted lateral positions.

As embodied herein, and to ensure proper location of the overlay-tape material spool 15 against the locating shoulder 238 of the spindle 216, a leaf spring 246 is fixedly connected at one end, such as by bolt 248, to the inside wall of the outside retainer plate bracket 214. The other end of the leaf spring 246 lightly engages the overlay-tape material spool 15 for maintaining the spool 15 against the spindle locating shoulder 238 during the operation of the apparatus 200.

In accordance with the invention, the third embodiment of the label-producing apparatus further comprises means for adjustably applying tension against the base-tape material spool independent of the overlay-tape material spool. Similar to the first and second embodiments of the invention, the adjustable tension-applying means for apparatus 200 comprises deformable drag discs 250 provided on opposite sides of the base-material spool 17 and an adjustable locating and tensioning screw 252 threadably mounted to the outside retainer plate bracket 214 as shown in FIGS. 13–15. The tensioning screw 252 contacts the deformable drag disc 250 and operates in a manner similar to that described previously with respect to the first and second embodiments of the label-producing apparatus. The fine adjustment of the tensioning screw 252 against drag disc 250 applies the least amount of necessary tension against the base-tape material spool independent of the overlay-tape material spool in accordance with the required operational tracking control and feed of the base-tape material to the roller means as will be described hereinafter. Of course, in addition to providing the necessary drag, the screw 252 also serves to locate the base-tape material spool 17 against the shoulder 240 of the spool spindle 218. The drag disc 250 used in this label-producing apparatus 250 can take one of the various embodiments for the drag disc as described for the first embodiment of the label-producing apparatus and as depicted in FIGS. 5–8.

In view of the foregoing construction of the subassembly 206, independent lateral feed alignment of the base-tape material 18 from spool 17 and the overlay-tape material 16 from the spool 15 can be readily achieved. Independent fine adjustment of the feed tensioning of the base-tape material 18 from spool 17 can also be readily achieved. Additionally, the outside retainer plate bracket 214 can be readily detached from the support plate bracket 210 of subassembly 206 for easy insertion and removal of the material spools 15 and 17. With both the locating leaf spring 246 and the tensioning screw 252 being attached to the outside retainer plate bracket 214, removal and attachment of the outside retainer bracket 214 can be achieved without affecting the previously-set lateral location of the spools 15 and 17 on the spindles, or the previously-set tensioning force against the base-material spool 17.

As embodied herein and as best shown in FIGS. 13–14, the second subassembly 208 for mounting the frictionally surface-driven feed roller is connected to the main frame 212 of the assembly 204. The subassembly 208 has a U-shaped frame support member 254 having side arm sections 256 and 258, as further illustrated in FIG. 13. Between the side arm sections 256 and 258 of the support member 254, there is rotatably mounted the frictionally surface-driven, pressure-loaded roller of the roller means. The frictionally surface-driven, pressure-loaded roller of the roller means for apparatus 200 comprises a feed roller 260 which has a construction and operation similar to that described with respect to the first embodiment. That is, the feed roller 260 includes an inner steel shaft and an outer surface of an approximately 50 durometer natural rubber. The shaft ends of the feed roller 260 are rotatably mounted in holes 262 formed at the lower end of the side arm sections 256 and 258 of the U-shaped support member 254 using bearings of the like.

In accordance with the invention, label-producing apparatus 200 further comprises means operably adjustable for varying the friction-force and pressure-load of the feed roller 260 against the platen 202. As embodied herein, and as illustrated in FIGS. 13–14, the adjustable means comprises a spring mechanism similar to the spring mechanism provided for the feed roller 132 of the second embodiment of the label-producing apparatus 100 shown in FIGS. 10 and 11. More specifically, there is provided springs 264 which are insertable into holes 266 formed in the side arm sections 256 and 258. One end of the spring 264 is received in a locating hole 268 of a block-type bearing 270. The holes 262 formed in the side arm sections 256 and 258 are elongated and the respective block-type bearing 270 are received therein. A screw 272 is threadably received into each of the holes 266, acts against the other end of the spring 264, and is adjustable for varying the biasing force of the spring 264 against the bearing 270 connected to the shaft end of the feed roller 260. With the use of the screws 272 and springs 264, the friction-force and pressure-load of the feed roller 260 can be very finely adjusted in accordance with the required operational feed of the base-tape material and clear-tape material through the feed roller 260 and platen 202 as indicated by the arrows A and B, respectively, in FIG. 14. Similar to the first embodiment, the drive roller of the roller means for the label-producing apparatus 200 comprises the platen 202 of the typewriter such that the overlay-tape and base-tape material are fed into and through the feed roller 260 and platen 202 for pressing the adhesive surface of the overlay-tape material into intimate contact with the printed surface of the base-tape material. A strip of laminated labels is fed from the roller assembly as indicated by arrow C in FIG. 14.

With the foregoing construction for the label-producing apparatus 200, a label-producing apparatus is available which can be utilized on many different types of typewriters, particularly electronic typewriters which have low drive capabilities and require optimum feeding control and tracking requirements to achieve a proper lamination operation. In addition, this label-producing apparatus 200 provides for an improved lamination by eliminating material misalignments and air pockets developed between the overlay-tape and base-tape materials during lamination because of irregular feed through the roller assembly and irregularities in the surface of the platen of the typewriter. In summary, this label-producing apparatus is more reliable in operation, has a higher quality lamination, is relatively simple in construction, and has easy loading and unloading of the tape spools from the mounting assembly.

The above-described embodiments of the label-producing apparatus have been shown to be of a type intended for use with various types of typewriters and printers. Accordingly, it is not intended that the invention be limited to the particular types of printers or typewriter environments which were described above with reference to the preferred embodiments of the apparatus. Moreover, the foregoing is considered as illustrative only of the principle of the invention. Since numerous modifications and changes will readily occur to those skilled in the art, it is not desired to limit the invention to the exact construction and operation of the embodiments shown and described. It is intended that the present invention cover the modifications and variations in the label-producing apparatus in accordance with the invention which fall within the scope of the appended claims and their equivalents.

What is claimed is:

1. An apparatus for producing laminated labels used in combination with a conventional typewriter or printer, the apparatus comprising:

(a) means for rotatably mounting a spool of transparent overlay-tape material having an adhesive surface;

(b) means for rotatably mounting a spool of base-tape material having a printable surface and an opposite protected adhesive surface, said base-tape material mounting means including means for adjustably applying tension against the base-tape material spool independent of said overlay-tape material spool;

(c) friction-feed, pressure-loaded roller means associated with the print head of the typewriter or printer for pulling without slippage the overlay-tape material and the tensioned base-tape material into and through the roller means at a constant surface speed therebetween and for pressing the adhesive surface of said overlay-tape material into intimate fixed contact with the printable surface of said base-tape material, said roller means including a drive roller, a frictionally surface driven, pressure-loaded feed roller having an outer compressible surface acting against the drive roller, and means for adjusting the friction-force and pressure-load of said surface-driven feed roller against said drive roller to apply the appropriate material pulling force according to the drive force of the conventional typewriter or printer with which the apparatus is used; and (d) means for mounting the roller means adjacent the print head of a conventional typewriter or printer for the roller means to receive the printed base-tape material therefrom.

2. The apparatus of claim 1, wherein means for adjustably applying tension against the base-tape material spool comprises deformable drag discs fixed on opposite sides of the base-tape material spool and means for applying force against the drag discs to deform the drag discs inwardly against said base-tape material spool at the outer peripheral portion thereof, thereby applying tension to said base-tape material spool.

3. The apparatus of claim 1, wherein the apparatus is adapted for use with a printer having a fixed platen and sheet-feeding tractor mechanism, and further comprises means for mounting the apparatus to said printer wherein said drive roller is operatively connected to the sheet-feeding tractor mechanism.

4. The apparatus of claim 1, wherein the apparatus is adapted for use with a typewriter or printer having a rolling platen and wherein said drive roller comprises the platen of said typewriter or printer.

5. The apparatus of claim 4, wherein said means for rotatably mounting said base-tape material spool comprises a first assembly for mounting said base-tape material spool which is removably connected to the housing of the typewriter or printer, or mounted externally from the typewriter or printer.

6. The apparatus of claim 5, wherein said means for rotatably mounting said overlay-tape material spool and said means for mounting said roller means comprises a second assembly for mounting both the overlay-tape material spool and roller means which is pivotally connected to said first mounting assembly.

7. The apparatus of claim 6, wherein said second mounting assembly further comprises a weight mechanism connected to said second assembly for providing a friction-force of the feed roller against the platen as a result of the moment caused by the weight and distance of the weight to the pivotable connection of said second mounting assembly to said first mounting assembly.

8. The apparatus of claim 7, wherein said weight mechanism is adjustable to vary the friction force of the feed roll against the platen.

9. The apparatus of claim 8, wherein said weight mechanism comprises a threaded rod attached to said second mounting assembly and a weight threadedly attached to and adjustable on said rod for varying the moment force of the feed roller against the platen.

10. The apparatus of claim 6, wherein said second assembly is pivotally movable away from said platen for alignment and initial feeding operations of the base-tape and overlay-tape materials.

11. The apparatus of claim 10, further comprising adjustable locating screw means threadedly attached to said second mounting assembly for laterally positioning the rotatably mounted overlay-tape material spool.

12. The apparatus of claim 10, wherein said means for adjustably applying tension against the base-tape material spool comprises deformable drag discs fixed on opposite sides of said base-material spool and adjustable locating and tensioning screw means attached to said first mounting assembly for laterally positioning the rotatably mounted base-tape material spool and for contacting the deformable drag discs to apply tension against the base-tape material spool independent of said overlay-tape material spool in accordance with the required operational feed of the base-tape material to the roller means.

13. The apparatus of claim 12, wherein said deformable drag discs have substantially thin deformable plate-like sidewalls and substantially rigid caps integrally formed therewith and projecting therefrom which are fixably insertable into the base-tape material spool.

14. The apparatus of claim 12, wherein said deformable drag discs have substantially-thin deformable plate-like sidewalls and a substantially rigid integrally formed center core upon which the base-tape material spool is wound.

15. The apparatus of claim 12, wherein the drag of the base-tape material is caused by the compression or deformation of the disc as the rotating disc runs over the adjustable tensioning screw means and wherein said tensioning screw means is mounted on said first assembly for contacting the surface of said drag disc at the outer circumference thereof.

16. The apparatus of claim 1, wherein the apparatus is adapted for use with a conventional typewriter having a moving, rolling platen and wherein said drive roll comprises the platen of said typewriter.

17. The apparatus of claim 16, wherein said means for rotatably mounting the base-tape material spool, said means for rotatably mounting the overlay-tape material spool, and said means for mounting said roller means comprise a mounting assembly removably connected to the platen and carriage of the typewriter, said mounting assembly including a first subassembly for rotatably mounting the overlay-tape material spool and the base-tape material spool having (i) a support plate bracket, (ii) an outside plate retainer bracket which is removably positioned parallel to said support plate bracket and which has stand-off legs extending therefrom for engaging said support bracket, (iii) spindles mounted to said support bracket and extending through said outside retainer bracket for respectively rotatably mounting the overlay-tape material spool and said base-tape material spool between said support plate bracket and outside plate retainer bracket; and (iv) a locking mechanism for removably locking said outside plate retainer bracket into position with the stand-off legs contacting said support plate bracket.

18. The apparatus of claim 17, wherein said first subassembly further comprises locating means at the ends of said spool spindles adjacent said support bracket for laterally locating said overlay-tape material spool and said base-tape spool on said spindles, and spring means attached to said outside plate retainer bracket for urging the overlay-tape material spool against said retaining means at the end of said overlay-tape material spool spindle.

19. The apparatus of claim 18, wherein said means for adjustably applying tension against the base-tape material spool comprises deformable drag discs on opposite sides of said base-tape material spool and adjustable locating and tensioning screw means attached to said outside plate retaining bracket for urging the base-tape material spool against the retaining means at the end of the base-tape material spool spindle and for contacting the deformable drag disc facing the outside plate retaining bracket to apply tension against the base-tape material spool independent of said overlay-tape material spool in accordance with the required operational feed of the base-tape material to the roller means.

20. The apparatus of claim 19, wherein said deformable drag discs have substantially thin deformable plate-like sidewalls and substantially rigid caps integrally formed and projecting therefrom which are fixably insertable into the base-tape material spool.

21. The apparatus of claim 19, wherein said deformable drag discs have substantially-thin deformable plate-like sidewalls and a substantially rigid integrally formed center core upon which the base-tape material spool is wound.

22. The apparatus of claim 19, wherein the drag of the base-tape material is caused by the compression or deformation of the disc as the rotating disc runs over the adjustable tensioning screw means and wherein said tensioning screw means is mounted on said outside plate retaining bracket for contacting the surface of said drag disc at the outer circumference thereof.

23. The apparatus of claim 17, wherein said mounting assembly comprises a second subassembly for mounting the frictionally surface-driven, pressure-loaded feed roller acting against the platen, the second subassembly including adjustable spring means acting against said frictionally surface-driven feed roller for adjustably applying the friction-force and pressure-load of said feed roller against said platen.

24. An apparatus for producing laminated labels used in combination with a printer having a fixed platen and sheet-feeding tractor mechanism with idle and drive shafts, the apparatus comprising:

(a) means for rotatably mounting a spool of transparent overlay-tape material having an adhesive surface;

(b) means for rotatably mounting a spool of base-tape material having a printable surface and an opposite protected adhesive surface, said base-tape material mounting means including means for adjustably applying tension against the base-tape material spool independent of said overlay-tape material spool;

(c) friction-feed, pressure-loaded roller means associated with the print head of the printer for pulling the overlay-tape and base-tape materials into and through the roller means and pressing the adhesive surface of said overlay-tape material into intimate contact with the printable surface of said base-tape material, said friction-force and pressure-load of said roller means being operably adjustable and said roller means including a drive roller and a frictionally surface-driven, pressure-loaded feed roller acting against the drive roller; and (d) means for mounting the roller means adjacent the print head of the printer, wherein the apparatus is adapted for use with the printer having the fixed platen and the sheet-feeding tractor mechanism with the idle and drive shafts, said drive roller being operatively connectable to the sheet-feeding tractor mechanism and the means for mounting the roller means and means for mounting the overlay-tape material spool including a first assembly for mounting both the overlay-tape material spool and roller means which is detachably mountable to the idle and drive shafts of the tractor mechanism of the printer.

25. The apparatus of claim 24, further comprising spring means acting against said frictionally surface-driven feed roller for applying the friction-force and pressure-load of said feed roller against said drive roller, said spring means being operably adjustable for varying the friction-force and pressure-load of said feed roller thereto.

26. The apparatus of claim 24, wherein said first mounting assembly further comprises a guiding mechanism connected thereto for guiding the base-tape material from the fixed platen of the printer to the drive and feed rollers.

27. The apparatus of claim 24, wherein the means for rotatably mounting the base-material spool comprises a second assembly for separately and detachably rotatably mounting the base-tape material spool to the printer housing and for supplying the base-tape material past the fixed platen of the printer.

28. The apparatus of claim 27, wherein said means for adjustably applying tension against the base-tape material spool comprises deformable drag discs fixed on opposite sides of said base-material spool and adjustable locating and tensioning screw means attached to said first mounting assembly for laterally positioning the rotatably mounted base-tape material spool and for contacting the deformable drag discs to apply tension against the base-tape material spool independent of said overlay-tape material spool in accordance with the required operational feed of said base-tape material to said roller means.

29. The apparatus of claim 28, wherein said drag discs are fixedly insertable into said base-tape material spool.

30. The apparatus of claim 28, wherein said drag discs are formed as an integral part of the base-tape material spool.

31. The apparatus of claim 28, wherein the drag of the base-tape material is caused by the compression or deformation of the disc as the rotating disc runs over the adjustable tensioning screw means and wherein said tensioning screw means is mounted on said second spool assembly for contacting the surfaces of said drag discs at the outer circumference thereof.

32. A drag disc for use in an apparatus for producing laminating labels from an overlay-tape material and a base-tape material having roller means for laminating the materials together, means for rotatably mounting a spool of base-tape material and feeding the base-tape material to the roller means and screw means for adjustably applying tension to the base-tape material spool, the disc comprising: a deformable drag disc fixably positionable on opposite sides of the base-tape material spool and having a substantially thin deformable plate-like sidewall wherein the drag of the base-tape material spool is caused by the inward deformation of the disc sidewall against said spool as the rotating disc runs over the adjustable tensioning screw means for providing required operational tensioned feed of the base-tape material to the roller means in the laminated label-producing apparatus.

33. The apparatus of claim 32, wherein said deformable drag disc has a single substantially thin deformable plate-like sidewall and a substantially rigid cap integrally formed and projecting therefrom which is fixably insertable into one side of the base-tape material spool.

34. The disc of claim 33, further comprising a locking tab formed on the outer circumference of said projecting cap for engaging the inner circumference of said base-tape material spool and fixedly securing the disc to the spool.

35. The disc of claim 34, wherein adhesive is provided on the locking tab for bonding to the inner circumference of said base-tape material spool and fixedly securing the disc to the spool.

36. The apparatus of claim 32, wherein the deformable drag disc comprises a pair of substantially-thin deformable plate-like sidewalls and a substantially rigid integrally formed center core therebetween upon which the base-tape material spool is wound between said pair of deformable sidewalls.

37. The disc of claim 32, wherein the disc sidewall extends slightly laterally outwardly from the center portion to the outer circumferential portion of said disc.

38. The disc of claim 37, wherein the sidewall has an outwardly extending angle of approximately 5–10 degrees.

39. The disc of claim 32, wherein said disc sidewall is formed of a deformable plastic.

* * * * *

UNITED STATES PATENT AND TRADEMARK OFFICE

CERTIFICATE OF CORRECTION

PATENT NO. : 4,564,411

DATED : January 14, 1986

INVENTOR(S) : Joseph C. Holzer

It is certified that error appears in the above-identified patent and that said Letters Patent is hereby corrected as shown below:

*Column 22, line 41, "apparatus" s/b --disc--;

line 54, "apparatus" s/b --disc--.

Signed and Sealed this

Twenty-fifth Day of November, 1986

*Attest:*

DONALD J. QUIGG

*Attesting Officer* *Commissioner of Patents and Trademarks*